US009810241B2

(12) United States Patent
Gell, III et al.

(10) Patent No.: US 9,810,241 B2
(45) Date of Patent: Nov. 7, 2017

(54) LOW PROFILE PUMP WITH THE ABILITY TO BE MOUNTED IN VARIOUS CONFIGURATIONS

(71) Applicant: Flow Control LLC., Beverly, MA (US)

(72) Inventors: William A. Gell, III, Danvers, MA (US); Jeffrey D. Lopes, Gloucester, MA (US); Jesus Estrada, Gloucester, MA (US); Randall H. Moormann, Georgetown, MA (US)

(73) Assignee: FLOW CONTROL LLC, Beverly, MA (US)

( * ) Notice: Subject to any disclaimer, the term of this patent is extended or adjusted under 35 U.S.C. 154(b) by 408 days.

(21) Appl. No.: 14/219,508

(22) Filed: Mar. 19, 2014

(65) Prior Publication Data

US 2014/0341752 A1 Nov. 20, 2014

Related U.S. Application Data

(60) Provisional application No. 61/803,265, filed on Mar. 19, 2013, provisional application No. 61/824,151, filed on May 16, 2013.

(51) Int. Cl.
*F04D 29/60* (2006.01)
*F04D 13/02* (2006.01)
(Continued)

(52) U.S. Cl.
CPC ..... *F04D 29/605* (2013.01); *F04D 13/021* (2013.01); *F04D 13/086* (2013.01);
(Continued)

(58) Field of Classification Search
CPC ..... F04D 1/12; F04D 13/086; F04D 15/0218; F04D 29/4293; F04D 29/466;
(Continued)

(56) References Cited

U.S. PATENT DOCUMENTS 1,780,679 A * 11/1930 Jennings ..... F04D 9/041 417/200
2,424,657 A * 7/1947 Goodman ..... F04D 15/0218 200/183

(Continued)

FOREIGN PATENT DOCUMENTS

CN 101220815 A 7/2008
DE 29508802 9/1996

(Continued)

OTHER PUBLICATIONS

JP57116194 1 page English Language Abstract.
JP200045984 English Language Abstract (1page).
English Language Abstract of CN101220815A.

*Primary Examiner* — Bryan Lettman
*Assistant Examiner* — Timothy Solak
(74) *Attorney, Agent, or Firm* — Ware, Fressola, Maguire & Barber LLP

(57) ABSTRACT

A pumping system featuring a pump chamber configured with a central portion having a tangential outlet, and configured with a tubular coupling end portion having inwardly flexible rim portions on one side; and a mounting base, having a circular portion with an inner circumferential rim configured to receive and engage the inwardly flexible rim portions of the tubular coupling portion of the pump chamber so as to be rotationally coupled to the pumping chamber so that the pumping chamber may be rotated 360° in relation to the mounting base.

13 Claims, 5 Drawing Sheets

Exploded View of a Low Profile Pump having a Basic 4-Part Design

(51) Int. Cl.

| | |
|---|---|
| ***F04D 29/42*** | (2006.01) |
| ***F04D 13/08*** | (2006.01) |
| ***F04D 15/02*** | (2006.01) |
| ***F04D 29/46*** | (2006.01) |

(52) U.S. Cl.
CPC ..... *F04D 15/0218* (2013.01); *F04D 29/4293* (2013.01); *F04D 29/466* (2013.01); *F05D 2260/33* (2013.01)

(58) Field of Classification Search
CPC .... F04D 29/606; F04D 13/021; F04D 29/605; F04D 29/007; F04D 29/406; F04D 29/70; F04D 29/708; F04D 1/00; F04D 13/0686; F04D 13/08; F04D 29/42; F04D 29/44; F04D 29/445; F04D 29/46; F04D 29/60; F05D 2260/33
See application file for complete search history.

(56) References Cited

U.S. PATENT DOCUMENTS

D162,502 S * 3/1951 Zimmer, Jr. ..... D15/7
2,643,615 A * 6/1953 Murphy ..... F04D 29/044 415/121.2
2,910,003 A * 10/1959 Kaatz ..... F04D 15/0218 200/83 A
3,044,406 A * 7/1962 Kristenson ..... H02K 5/132 310/53
3,064,340 A * 11/1962 Green ..... B64D 37/16 29/240
D195,748 S * 7/1963 Lorenz ..... D15/7
3,408,942 A * 11/1968 Davenport ..... B63B 13/00 417/421
3,637,326 A * 1/1972 Dowell ..... F04D 15/0218 417/44.3
3,695,776 A * 10/1972 Rule ..... F04D 9/02 415/182.1
3,700,002 A * 10/1972 Christie ..... E03B 11/00 137/565.17
3,717,420 A * 2/1973 Rachocki ..... F04D 15/0218 417/12
3,717,421 A * 2/1973 Schaefer ..... F04D 15/0218 417/38
3,807,900 A * 4/1974 Delancey ..... F04D 29/606 417/40
3,861,831 A * 1/1975 Rule ..... F04D 9/001 417/423.14
3,966,361 A * 6/1976 House ..... F04D 29/605 417/231
4,218,195 A * 8/1980 Shure ..... F04D 13/068 417/411
D264,085 S * 4/1982 Clay ..... D15/7
4,512,724 A * 4/1985 Horvath ..... A01K 63/047 210/167.21
4,645,426 A * 2/1987 Hartley ..... F04B 49/025 417/38
D292,978 S * 12/1987 Hansen ..... D15/7
D303,532 S * 9/1989 Gresens ..... D15/7
4,932,848 A * 6/1990 Christensen ..... F04D 13/086 417/368
5,141,390 A * 8/1992 Haentjens ..... F04D 13/08 415/148
5,151,016 A * 9/1992 Her ..... F04D 29/588 417/32
5,193,977 A * 3/1993 Dame ..... A61M 1/1046 277/634
5,288,215 A * 2/1994 Chancellor ..... F04D 13/0646 417/423.11
5,466,127 A * 11/1995 Arnswald ..... F04D 13/086 417/38
5,545,012 A * 8/1996 Anastos ..... F04B 49/02 318/484
5,746,582 A * 5/1998 Patterson ..... E21B 23/02 166/377
5,785,013 A * 7/1998 Sinn ..... H02K 11/33 123/41.44
5,893,589 A * 4/1999 Bleitz ..... F16L 37/244 285/148.19
6,102,657 A * 8/2000 Chalberg ..... F04D 29/4273 415/200
6,167,965 B1 * 1/2001 Bearden ..... E21B 43/121 166/105.5
6,174,146 B1 * 1/2001 Lacy ..... F04D 15/0218 417/423.14
6,175,173 B1 * 1/2001 Stephan ..... F04D 29/588 310/87
6,257,626 B1 * 7/2001 Campau ..... F16L 37/0985 285/319
6,276,908 B1 * 8/2001 Batchelder ..... F04D 13/06 417/360
6,446,506 B1 * 9/2002 VanZuilen ..... H01H 35/18 200/80 R
6,676,382 B2 * 1/2004 Leighton ..... F04D 29/2222 417/12
6,945,835 B1 * 9/2005 Akhavein ..... B63H 20/30 440/88 N
D517,570 S * 3/2006 Stiles, Jr. ..... D15/7
7,156,614 B2 * 1/2007 Racer ..... F04D 7/04 415/116
7,183,741 B2 * 2/2007 Mehlhorn ..... F04D 15/0218 318/805
7,284,968 B2 * 10/2007 Tsai ..... F04D 27/00 141/313
D573,607 S * 7/2008 Bulter ..... D15/7
7,407,371 B2 * 8/2008 Leone ..... F04D 15/0066 417/423.1
D576,640 S * 9/2008 Sinico ..... D15/7
7,442,014 B1 * 10/2008 Mellinger ..... F04D 1/06 417/18
D606,562 S * 12/2009 Stiles, Jr. ..... D15/5
D609,595 S * 2/2010 Soderstrom ..... D15/7
7,748,965 B2 * 7/2010 Schopperle ..... F04D 29/605 417/361
7,755,318 B1 * 7/2010 Panosh ..... F04B 49/065 318/778
7,828,531 B2 * 11/2010 Heng ..... F04D 13/08 417/423.11
D629,423 S * 12/2010 Varini ..... D15/7
8,002,522 B2 * 8/2011 Ihle ..... F04D 29/026 156/272.8
8,021,133 B2 * 9/2011 Binder ..... F04B 15/08 415/177
D649,163 S * 11/2011 Moormann ..... D15/7
D657,799 S * 4/2012 Jung ..... D15/7
8,167,578 B2 * 5/2012 Lin ..... F04B 49/025 417/36
8,226,385 B2 * 7/2012 Wendel ..... E21B 43/128 310/52
D667,466 S * 9/2012 Barmore ..... D15/7
8,282,367 B2 * 10/2012 Ihle ..... F04D 29/5893 310/86
8,348,606 B2 * 1/2013 Gopalan ..... F04D 29/242 415/206
8,371,831 B2 * 2/2013 Marioni ..... A47L 15/4225 417/423.1
8,425,205 B2 * 4/2013 Li ..... F04D 29/445 417/295
8,435,016 B2 * 5/2013 Telakowski ..... F04C 18/0215 184/6.16
D684,197 S * 6/2013 Kienzle ..... D15/9
D701,246 S * 3/2014 Cook ..... D15/7
8,864,476 B2 * 10/2014 Moormann ..... F04B 17/03 417/411
D735,240 S * 7/2015 Cook ..... D15/7
2002/0047240 A1 * 4/2002 Radosav ..... F16J 15/3452 277/389
2003/0091440 A1 * 5/2003 Patel ..... F04B 39/121 417/12

(56) References Cited

U.S. PATENT DOCUMENTS

2003/0190243 A1* 10/2003 Eddy ..... H01R 13/5219 417/423.3
2004/0018094 A1* 1/2004 Rossman ..... F04D 15/0218 417/40
2004/0191090 A1* 9/2004 Patel ..... F04B 39/121 417/360
2006/0228238 A1* 10/2006 Andrews ..... F04D 13/06 417/423.1
2007/0048157 A1* 3/2007 Collins ..... F04D 15/0218 417/423.3
2007/0086903 A1* 4/2007 Schopperle ..... F04D 29/4293 417/360
2007/0086906 A1* 4/2007 Horley ..... F04D 13/06 417/423.12
2007/0183905 A1* 8/2007 Hoffmeier ..... F04D 13/086 417/279
2008/0317592 A1* 12/2008 Adler ..... F04D 29/4293 415/213.1
2009/0056123 A1* 3/2009 Phillips ..... F04B 17/03 29/888
2009/0123295 A1* 5/2009 Abbott ..... F04D 15/0218 417/36
2009/0175737 A1* 7/2009 Intelisano ..... E21B 43/128 417/244
2010/0028166 A1* 2/2010 Collins ..... F04D 15/0218 417/44.1
2010/0090140 A1* 4/2010 Phillips ..... F16K 37/0083 251/129.01
2010/0111687 A1* 5/2010 Colic ..... F04D 13/0606 415/204
2010/0119391 A1* 5/2010 Colic ..... F04D 29/086 417/423.14
2010/0166570 A1* 7/2010 Hampton ..... F04B 49/065 417/36
2011/0002791 A1* 1/2011 Meza ..... F04D 15/0077 417/14
2011/0027104 A1* 2/2011 Kragelund ..... F04D 15/0218 417/36
2011/0182718 A1* 7/2011 Rasmussen ..... F04D 29/0413 415/170.1
2011/0182725 A1* 7/2011 Rasmussen ..... F04D 1/06 415/203
2012/0024767 A1* 2/2012 Bovill ..... F04B 49/02 210/97
2012/0118412 A1* 5/2012 Barry ..... F04D 15/0218 137/565.01
2012/0171051 A1* 7/2012 Wallace ..... F04F 3/00 417/53
2012/0290227 A1* 11/2012 Estrada ..... G01F 23/266 702/55
2013/0052060 A1* 2/2013 Meza ..... F04B 17/06 417/411
2013/0089437 A1* 4/2013 Kennedy ..... F04B 19/006 417/44.1
2013/0121811 A1* 5/2013 Cuppetelli ..... F04D 29/2288 415/121.1
2013/0294928 A1* 11/2013 Rosinski ..... F04D 13/06 417/5
2013/0336763 A1* 12/2013 Lopes ..... F04D 15/0094 415/51
2015/0159657 A1* 6/2015 Roussel ..... F04D 15/0209 417/12
2015/0247501 A1* 9/2015 Moormann ..... F04D 1/00 415/147
2015/0247502 A1* 9/2015 Moormann ..... F04D 29/406 415/182.1
2015/0247504 A1* 9/2015 Moormann ..... F04D 15/0227 417/36

FOREIGN PATENT DOCUMENTS

| | | |
|---|---|---|
| GB | 987300 | 3/1965 |
| GB | 989899 | 4/1965 |
| GB | 1175776 | 12/1969 |
| GB | 1485815 | 9/1977 |
| GB | 2038944 | 7/1980 |
| GB | 2135731 | 9/1984 |
| GB | 2328719 | 3/1999 |
| JP | 57116194 | 7/1982 |
| JP | 200045984 | 2/2000 |
| WO | 9641082 | 12/1996 |
| WO | 2004038228 | 5/2004 |

* cited by examiner

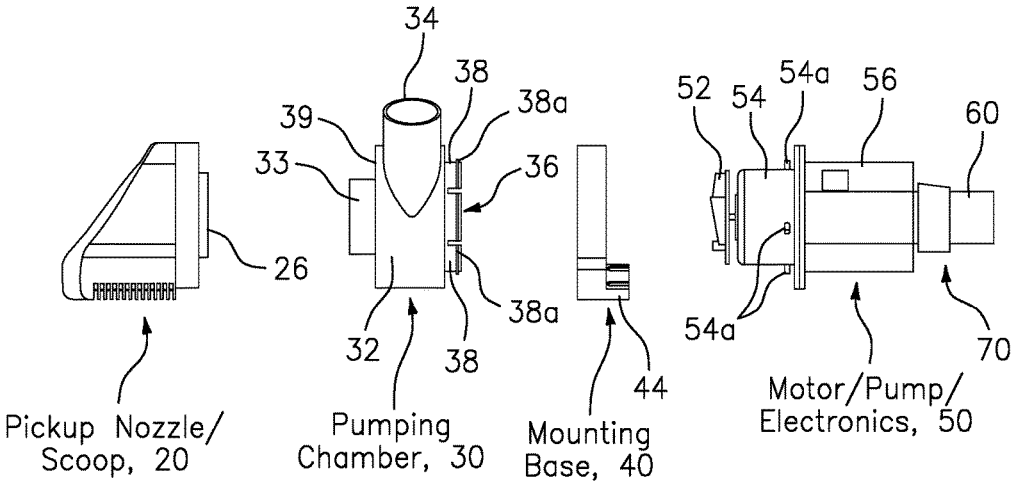
*FIG. 3*: Exploded View of a Low Profile Pump having a Basic 4–Part Design
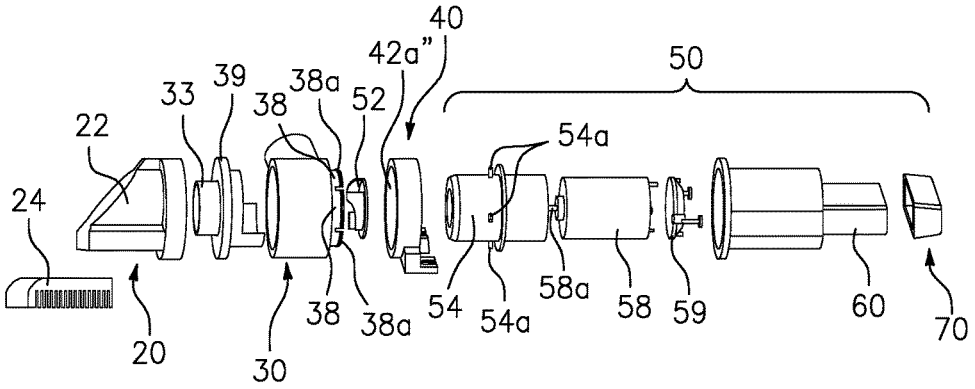
*FIG. 4*: Further Exploded View of the Low Profile Pump

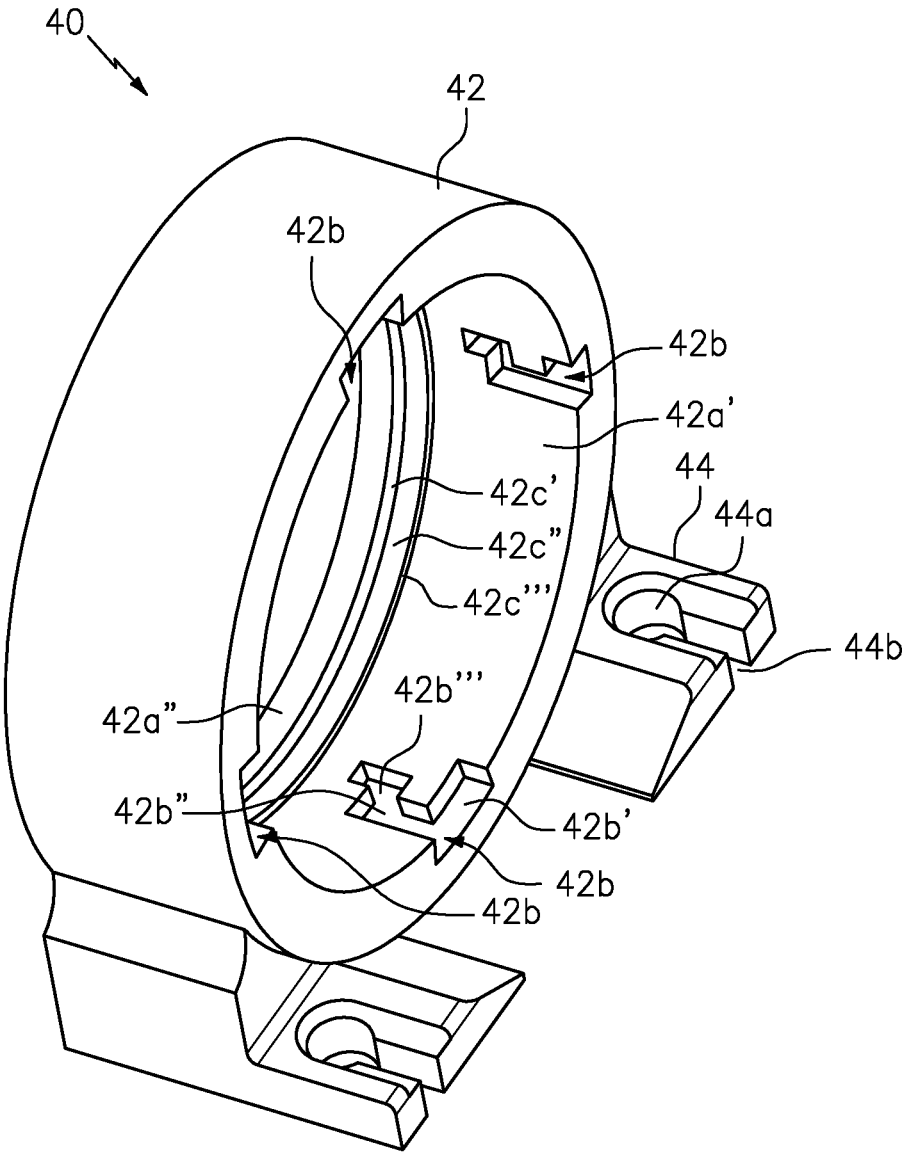
*FIG. 5*: The Mounting Base 40 of the Low Profile Pump 10

*FIG. 8a*: Sensor at High Stting

*FIG. 8b*: Sensor at Low Stting

LOW PROFILE PUMP WITH THE ABILITY TO BE MOUNTED IN VARIOUS CONFIGURATIONS

CROSS REFERENCE TO RELATED APPLICATION

This application claims benefit to provisional patent application No. 61/803,265, filed 19 Mar. 2013, as well as provisional patent application No. 61/824,151, filed 16 May 2013, which are both hereby incorporated by reference in its entirety.

BACKGROUND OF THE INVENTION

1. Field of the Invention

The present invention relates to a pump or pumping system, including a bilge pump for mounting in a vessel.

2. Brief Description of Related Art

Pumps are known and used to move bilge water or work in confined areas with hoses attached for directing the water to a desired exit point or area. A mechanical or electronic switching method is typically used to turn the pump on/off.

Known pumping devices are limited in the angles or flexibility in the discharge outlet of the pump reducing the overall attractiveness and fit for the purpose that they are intended to achieve. Another limitation is in the switching options that are available.

SUMMARY OF THE INVENTION

In summary, the present invention provides a low profile pump having the ability to be mounted in various configurations, utilizing several methods of power switching, and having discharge angle flexibility with multiple versions and discharge outputs. The ability to be mounted in various configurations is characterized by a new and unique cooperation between a pump chamber and a mounting base that allows a full 360° rotation of the pump chamber in relation to the mounting base.

THE BASIC INVENTION

By way of example, and according to some embodiments, the present invention may take the form of a pumping system featuring a pump chamber in combination with a mounting base. The pump chamber may be configured with a central portion having an outlet, including a tangential outlet, and also configured with a tubular coupling end portion having inwardly flexible portions, each with a respective outwardly extending raised rim; and the mounting base may include a circular portion having an inner circumferential wall with an inner circumferential recess configured therein to receive and engage the outwardly extending raised rims of the inwardly flexible portions of the tubular coupling portion of the pump chamber, so that the pumping chamber is rotationally coupled to the mounting base for 360° rotation.

Embodiments of the present invention may also include one or more of the following features:

The pumping system may include a pickup nozzle or scoop having a tubular coupling and axial outlet end; and the pump chamber may be configured with a tubular coupling and axial inlet end portion on another side to couple to the tubular coupling and axial outlet end of the pickup nozzle or scoop. The coupling between the pickup nozzle or scoop and the pump chamber may include, or take the form of, rotational or fixed coupling, depending on the particular application of the pumping system.

The mounting base may include one or more lower mounting legs with apertures formed therein and may be configured to be mounted to a surface or workpiece, including via a fastener.

The pumping system may include a motor, pump and electronics assembly having an impeller; and the mounting base and the motor, pump and electronics assembly may be coupled together using a detent and slot arrangement so that the impeller extends into the pumping chamber.

The motor, pump and electronics assembly may include a housing configured with at least one outwardly extending detent; and the mounting base may include a circumferential wall configured with at least one inwardly extending slot for receiving the at least one outwardly extending detent of the housing for coupling together the mounting base and motor, pump and electronics assembly.

The circumferential wall may take the form of an inner circumferential wall having at least one recessed slot formed therein for receiving the at least one outwardly extending detent of the housing for coupling together the mounting base and motor, pump and electronics assembly.

The circumferential wall may be configured with at least one slotted opening formed therein for receiving the at least one outwardly extending detent of the housing for coupling together the mounting base and motor, pump and electronics assembly.

The pumping system is, or forms part of, a bilge pump.

The pumping system may also include a switching assembly having a printed circuit board assembly with a water level sensor configured to respond to a water level and turn a motor in the motor, pump and electronics assembly on and off, the switching assembly arranged in a housing part of the motor, pump and electronics assembly; the at least one outwardly extending detent may include two diametrically opposed outwardly extending detents formed or configured thereon; and the at least one inwardly extending slot may include two diametrically opposed inwardly extending slots for receiving the two diametrically opposed outwardly extending detents of the housing for coupling together the mounting base and motor, pump and electronics assembly in at least two rotational orientations that differ by about 180°, including

- a first rotational orientation so that the water level sensor is located at a higher height in the housing part for providing a higher water level sensing setting, and
- a second rotational orientation so that the water level sensor is located at a lower height in the housing part for providing a lower water level sensing setting.

In effect, the pump according to the present invention has the unique ability to pump a liquid utilizing a pickup scoop or nozzle and with a more flexible arrangement of a discharge port than has been achieved in other pumps of this nature known in the art. The flexible rotational nature of the discharge port that has full rotation and with the additional port adapters of various angles available can rotate into many positions on multiple axes. This has not been achieved by other pumps of this nature known in the art.

BRIEF DESCRIPTION OF THE DRAWING

The drawing includes the following Figures, which are not necessarily drawn to scale:

FIG. 3 is an exploded side view of a low profile pump, according to some embodiments of the present invention.

FIG. 4 is a further exploded side view of the low profile pump in FIG. 3, according to some embodiments of the present invention.

FIG. 5 is a perspective view of a mounting base that forms part of the low profile pump, according to some embodiments of the present invention.

FIG. 8*a* shows the low profile pump having a motor/pump/electronics assembly configured so that a water level sensor on a Printed Circuit Board Assembly (PCBA) is located for a higher water level sensing setting, according to some embodiments of the present invention; and where FIG. 8*b* shows the low profile pump having the motor/pump/electronics assembly configured so that the water level sensor on the PCBA is located for a lower water level sensing setting, according to some embodiments of the present invention.

FIGS. 1-8 are described herein using accompanying reference numerals and lead lines. To reduce clutter in the drawing, similar elements in different Figures are not all labeled with reference labels. Moreover, the embodiments shown in FIGS. 1-5 and FIGS. 6-7 contain many similar elements. In view of this, elements in FIGS. 6-7 that correspond to similar elements shown in FIGS. 1-5 are labeled with similar reference numerals with the addition of 100.

DETAILED DESCRIPTION OF THE INVENTION

Figure 1:
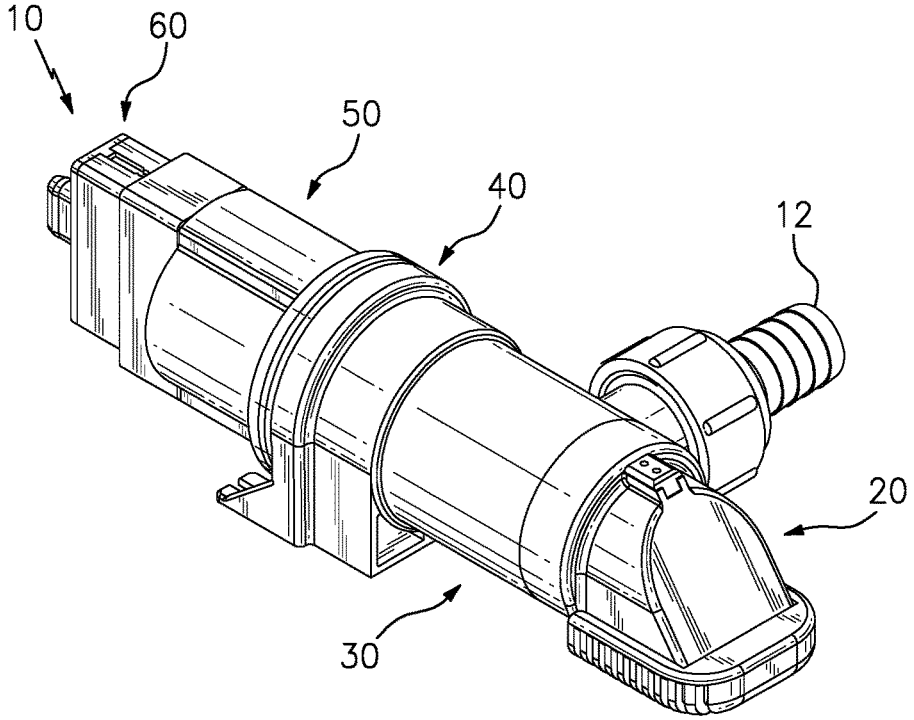
FIG. 1 shows a top down perspective view of an assembled low profile pump, according to some embodiments of the present invention.
Figure 2:
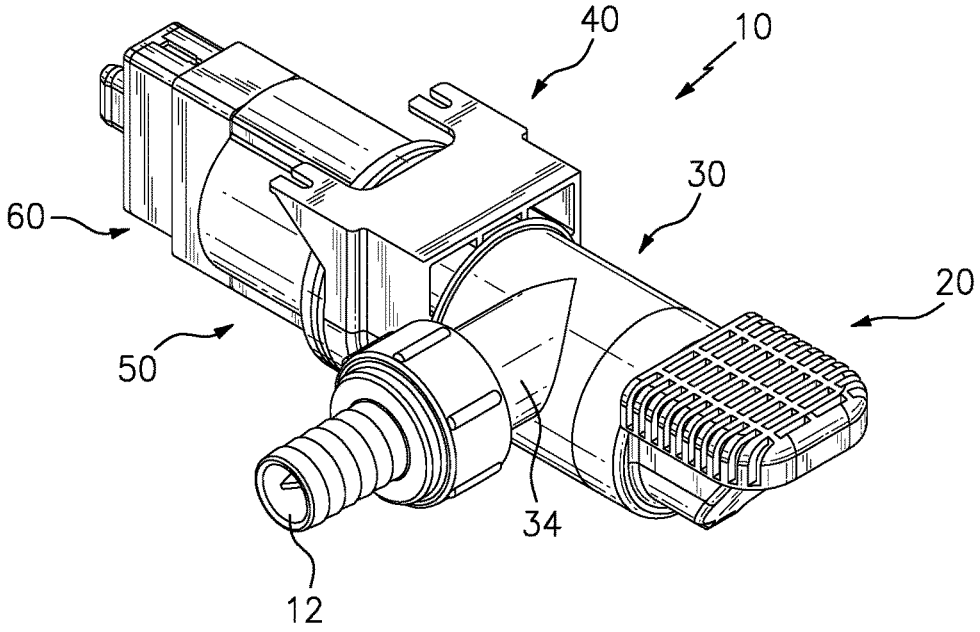
FIG. 2 shows a bottom up perspective view of the assembled low profile pump shown in FIG. 1, according to some embodiments of the present invention.

FIGS. 1-5 show a low profile pumping system according to some embodiments of the present invention generally indicated as 10, having four basic parts or components, including a pickup nozzle/scoop generally indicated as 20, a pumping chamber generally indicated as 30, a mounting base generally indicated as 40, a motor/pump/electronics assembly generally indicated as 50 and a switch assembly, circuit or arrangement generally indicated as 60. The low profile pump 10 may take the form of a bilge pump for mounting in the bilge of a boat or vessel for pumping water from the bilge out of the boat or vessel. In FIGS. 1-2, the pump 10 is shown with an optional adapter 12 in dashed lines that may be configured on a discharge port or outlet 34 of the pumping chamber 30 depending on the particular application. For example, the adapter 12 may be configured with suitable hosing (not shown) for use as a conduit for providing the fluid being pumped, e.g., out of the boat or vessel. The mounting base 40 (e.g., see also FIG. 5) may be configured so the pump 10 is mounted or affixed to some surface, e.g., in the bilge of the boat or vessel.

According to some embodiments of the present invention, the pumping system 10 may include a new and unique combination of a pump or pumping chamber 30 and a mounting base 40. The pump chamber 30 may be configured with a central portion 32 having the outlet 34, and also configured with a tubular coupling end portion 36 having inwardly flexible portions 38, each with a respective outwardly extending raised rim 38*a*; and the mounting base 40 may include a circular or central portion 42 having one or more inner circumferential rims or walls 42*a*', 42*a*" with an inner circumferential recess 42*c*'" formed therein and configured to receive and engage the outwardly extension raised rims 38*a* of the inwardly flexible rim portions 38 of the tubular coupling portion 36 of the pump chamber 30, e.g., when the tubular coupling end portion 36 of the pump chamber 30 is pushed into the circular portion 42 of the mounting base 40, so that the pumping chamber 30 is rotationally coupled to the mounting base 40 for 360° rotation.

Figure 6:
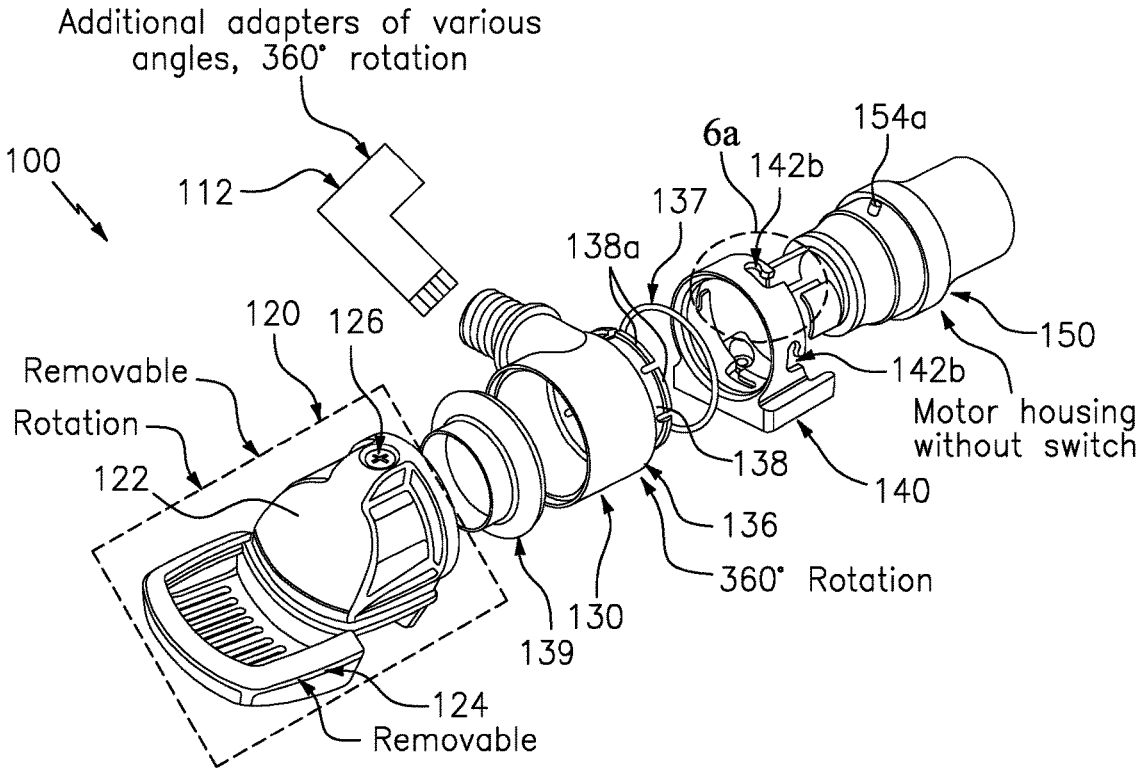
FIG. 6 is an exploded top perspective side view of a low profile pump having a motor housing without a switch included, according to some embodiments of the present invention.
Figure 6A:
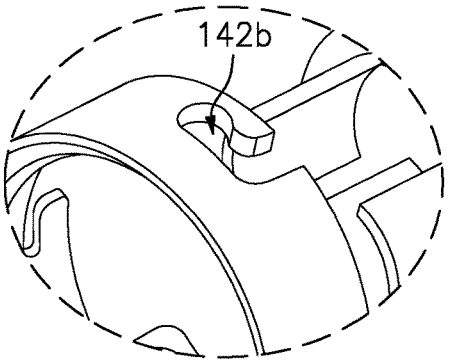
Figure 7:
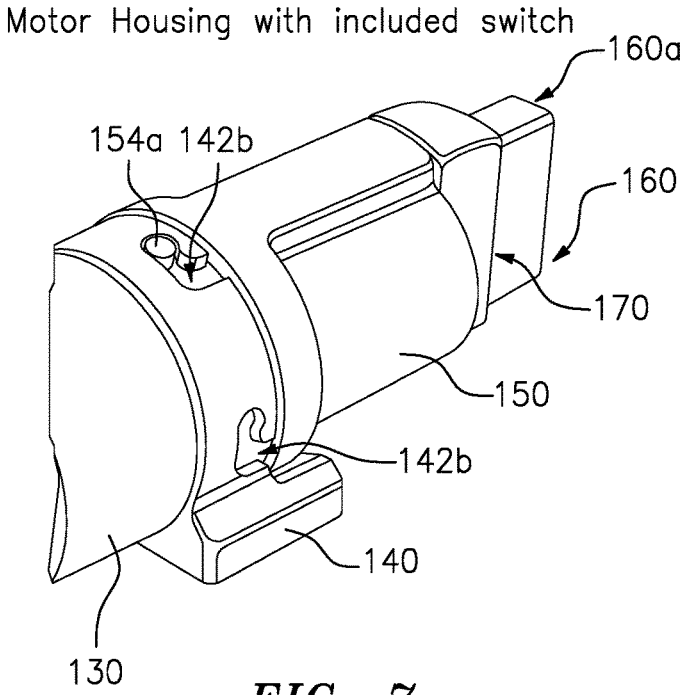
FIG. 7 is an assembled perspective view of a low profile pump shown having a motor housing with a switch included, according to some embodiments of the present invention.

The pumping system shown in FIGS. 6-7 includes a similar new and unique combination of a pump chamber 130 and a mounting base 140.

The embodiments shown in FIGS. 1-5 and 6-7 are now described in further detail.

FIGS. 1-5

In FIGS. 3-4, the pickup nozzle or scoop 20 forms a first part of the overall pumping system 10 and may include a nozzle or scoop portion 22 and a sliding strainer 24 that can be easily removed for cleaning. In addition to the removable strainer screen 24, the entire pick-up nozzle or scoop portion 22 and its supporting structure can be fully rotated through 360 degrees. The pickup nozzle or scoop 20 also includes an outlet portion 26 that may be coupled to the pumping chamber 30 so that when the pumping chamber 30 is rotated 360° in relation to the mounting base 40, the pickup nozzle or scoop 20 may similarly rotate 360° in relation to the mounting base 40. Alternatively, embodiments are envisioned in which the outlet portion 26 is coupled to the pumping chamber 30 so that when the pumping chamber 30 is rotated 360° in relation to the mounting base 40, the pickup nozzle or scoop 20 does not rotate in relation to the mounting base 40.

The pumping chamber 30 forms a second part of the overall pumping system 10 and includes the central portion 32 having the outlet 34 as shown, a tubular coupling and axial inlet end portion 33 on its left side as shown to rotationally couple to the outlet portion 26 of the pickup nozzle or scoop 20, and also the tubular coupling end portion 36 having the inwardly flexible portions 38 with the raised rims 38*a* on its right side as shown. In FIGS. 3-4, the tubular coupling end portion 36 is shown having eight inwardly flexible portions 38, each with a respective raised rims 38*a* on its right side as shown. (FIGS. 3-4 show one side of the pumping system 10, and four of the eight inwardly flexible portions 38.) However, embodiments are envisioned, and the scope of the invention is intended to include, using fewer than eight inwardly flexible portions 38, or using more than eight inwardly flexible portions 38, within the scope and spirit on the present invention. In effect, the scope of the invention is not intended to be limited to the number of inwardly flexible portions 38 or raised rims 38*a*. The tubular coupling and axial inlet end portion 33 may form part of a volute portion 39 configured to form part of the pumping chamber 30. By way of example, the tubular coupling and axial inlet end portion 33 of the pumping chamber 30 may be rotationally coupled to the outlet portion 26 of the pickup nozzle or scoop 20 using one or more O-rings (not shown). In addition, the tubular coupling and axial inlet end portion 33 of the pumping chamber 30 may include a raised portion, e.g. similar to the raised rim of the inwardly flexible portions 38, for engaging a corresponding rim or recess portion associated with, or configured in, the outlet portion 26 of the pickup nozzle or scoop 20, e.g., similar to the inner circumferential recess 42*c*''' of the mounting base 40.

The mounting base 40 forms a third part of the overall pumping system 10 that is best shown in FIG. 5. The inner circumferential rim or wall 42*a* may be configured with at least two recessed coupling portions 42*b* formed or configured therein, as shown, each for receiving a respective outwardly extending, detent, tab or protrusion 54*a* of a motor housing 54. By way of example, the at least two recessed coupling portions 42*b* include four recessed coupling portions 42*b* arranged at 0°, 90°, 180° and 270°, consistent with that shown in FIG. 5. Each recessed coupling portion 42*b* may include a first recessed portion 42*b*', a second recessed portion 42*b*'', and a third recessed portion 42*b*''', consistent with that shown in FIG. 5. In operation, the respective outwardly extending tab or protrusion 54*a* may be received by the first recessed portion 42*b*', rotated clockwise into a position so as to be received by the second recessed portion 42*b*'', pushed axially into the second recessed portion 42*b*'' so as to be received by the third recessed portion 42*b*''', and rotated clockwise and then pushed axially back into the third recessed portion 42*b*''' so as to couple the motor housing 54 to the mounting base 40.

The present invention is shown having four recessed coupling portions 42*b* for cooperating with four corresponding outwardly extending, detents, tabs or protrusions 54*a*; however, embodiments are envisioned, and the scope of the invention is intended to include, using fewer than four recessed coupling portions 42*b* for cooperating with fewer than four corresponding outwardly extending tab or protrusions 54*a*, as well as using more than four recessed coupling portions 42*b* for cooperating with more than four corresponding outwardly extending detents, tabs or protrusions 54*a*, within the spirit and scope of the present invention. Moreover, the present invention is shown having three recessed portions 42*b*', 42*b*'' and 42*b*''', however, embodiments are envisioned, and the scope of the invention is intended to include, using fewer than three recessed portions 42*b*', 42*b*'' and 42*b*''' for cooperating with the corresponding outwardly extending detents, tabs or protrusions 54*a*, as well as using more than three recessed portions 42*b*', 42*b*'' and 42*b*''' for cooperating with the corresponding outwardly extending, detents, tabs or protrusions 54*a*, within the spirit and scope of the present invention.

The inner circumferential rim or wall 42*a*'' may be configured with one or more wall portions 42*c*', 42*c*'' formed or configured therein, as shown, each for receiving the outwardly extension raised rims 38*a* of the inwardly flexible rim portions 38 of the tubular coupling portion 36 of the pump chamber 30. For example, the wall portion 42*c*' may be configured as an inwardly sloping surface so as to flex or push the inwardly flexible rim portions 38 as they are pushed axially into the central portion 42 of the mounting base 40. The wall portion 42*c*'' may be configured as a non-sloping surface so as to allow the inwardly flexible rim portions 38 to move towards the inner circumferential recess 42*c*'''. In operation, when the outwardly extending raised rims 38*a* are pushed far enough into the central portion 42 and reach the inner circumferential recess 42*c*''', then the inwardly flexible rim portions 38 flex back outwardly into the inner circumferential recess 42*c*''', and the outwardly extending raised rims 38*a* engage the inner circumferential recess 42*c*''', so that the pump chamber 30 is rotationally coupled to and free to be rotated 360° in relation to the mounting base 40. Embodiments are envisioned, and the scope of the invention is intended to including, using one wall portions 42*c*' or 42*c*''. For example, only the wall portion 42*c*' may be used and configured as the inwardly sloping surface so as to flex or push the inwardly flexible rim portions 38 as they are pushed axially into the central portion 42 of the mounting base 40, and when the outwardly extension raised rims 38*a* are pushed far enough into the central portion 42 and reach the inner circumferential recess 42*c*''', then the inwardly flexible rim portions 38 flex back outwardly, and the outwardly extending raised rims 38*a* engage the inner circumferential recess 42*c*'''. Alternatively, only the wall portion 42*c*'' may be used, configured and dimensioned as a non-sloping surface so as to flex or push the inwardly flexible rim portions 38 as they are pushed axially into the central portion 42 of the mounting base 40, and when the outwardly extending raised rims 38*a* are pushed far enough into the central portion 42 and reach the inner circumferential recess 42*c*''', then the inwardly flexible rim portions 38 flex back outwardly into the inner circumferential recess 42*c*''', and the outwardly extending raised rims 38*a* engage the inner circumferential recess 42*c*'''. (In effect, in this embodiment, the diameter of the wall portion 42*c*'' of the central portion 42 would be slightly less than the corresponding diameter of the tubular coupling portion 36 having the inwardly flexible rim portions 38.)

In addition, FIG. 5 also shows the mounting base 40 having mounting legs 44 and associated apertures 44*a* that are arranged in a coplanar configuration for attaching or fastening the mounting base 40 on a corresponding flat planar surface (not shown). By way of example, the mounting base 40 may be configured with two mounting members or legs 44, each having an aperture 44*a* formed or configured therein for mounting the mounting base 40 to a surface (not shown), e.g., via a fastener (not shown). Each mounting member or leg 44 may also have a slot 44*b* formed or configured therein for receiving the fastener (not shown), e.g., so as to allow the mounting base 40 to be slidably decoupled from the fastener without having to remove the fastener from the surface. Alternatively, embodiments are envisioned in which the two mounting members or legs 44 are only configured with apertures 44*a*, but no slots 44*b*, e.g., so the mounting base 40 cannot get free if the fasteners loosen over time.

Consistent with that shown in FIGS. 3-4. the motor, pump and electronics assembly 50 forms the fourth part of the overall pumping system 10 and may be configured to be mounted in the mounting base 40, e.g., via the aforementioned detent and slot arrangement, so that its impeller 52 extends into the pumping chamber 30. The detent and slot arrangement includes a cooperation between the recessed coupling portions 42*b* and the outwardly extending detents, tabs or protrusions 54*a*, e.g., consistent with that set forth above, so that the motor housing 54 of the motor, pump and electronics assembly 50 can couple to the mounting base 40 and the impeller 52 can extend into the pumping chamber 30. In addition, the motor, pump and electronics assembly 50 may include, or take the form of, a two-part housing 54, 56, where the one housing part 54 has the outwardly extending tab or protrusions 54*a* formed or configured thereon. The two-part housing 54, 56 is configured to receive and contain a motor 58 having a motor shaft 58*a* for coupling to the impeller 52, as well as suitable electronics like PCBA 62 for operating the motor 58.

The motor, pump and electronics assembly 50 also include an assembly 59 for coupling the motor 58 to the housing 54.

Figure 8:
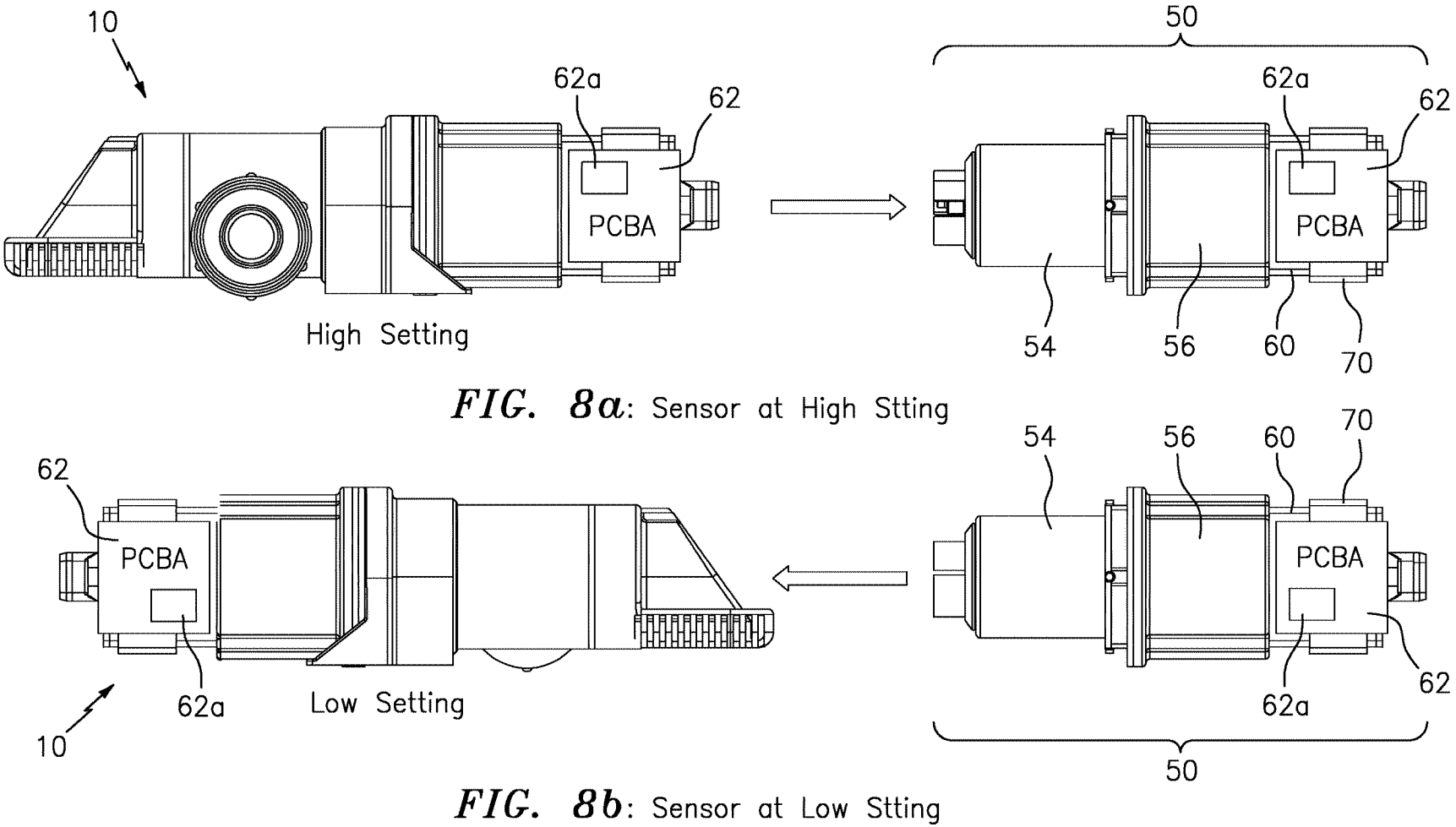
FIG. 8 includes FIGS. 8*a* and 8*b*, where

By way of example, the outwardly extending detents, tabs or protrusions 54*a* may include four outwardly extending detents, tabs or protrusions 54*a* arranged at 0°, 90°, 180° and 270° for cooperating with the four recessed coupling portions 42*b* also arranged at 0°, 90°, 180° and 270°, so as to be able to orient the motor, pump and electronics assembly 50 in relation to the mounting base 40 in four rotational orientations. This flexibility allows the user to change the water level sensor setting, consistent with that set forth in relation to FIG. 8 below.

The pump 10 may also be configured with the switch assembly 60 for turning the motor on/off, as well as one or more other mechanisms 70, e.g., including a level sensor configured to turn the switch on/off depending on some sensed condition. The switch assembly 60 includes a PCBA 62 for controlling the operation of the pump, having a water level sensor circuit 62 configured to sense the high/low water level and turn the pump on/off, consistent with that described in further detail below in relation to FIG. 8. The switch assembly 60 and/or the one or more other mechanisms 70 may be configured with switching functionality consistent with that set forth below.

FIG. 6-7

According to some embodiments, the present invention may take the form of a pumping system generally indicated as 100 as shown in FIGS. 6-7. The pumping system 100 includes a similar four-part construction, having a pick-up or nozzle or scoop generally indicated as 120, a pumping chamber generally indicated as 130, a mounting base generally indicated as 140 and a motor/pump/electronic assembly 150, which are similar in their overall functionality to elements 20, 30, 40 and 50 shown in FIGS. 1-5.

By way of example, the pick-up nozzle or scoop 120 may include a nozzle or scoop portion 122 and a removable sliding strainer 124 that can be easily removed from the nozzle or scoop portion 122 for cleaning. In addition to the removable strainer screen 124, the pick-up nozzle or scoop 120 and its associated supporting structure as shown may be configured to be rotated through 360 degrees, consistent with that set forth in relation to the pickup nozzle/scoop 20. The pick-up or nozzle or scoop 120 may also be configured to contain an anti-airlock device or aperture formed therein that prevents trapped air from affecting the pumping operation. For example, to overcome an air lock condition, the pumping system 100 may be configured to release entrapped air, the air may be allowed to "bleed" out to the atmosphere allowing the water to rise and engage the impeller. By way of example, see a related patent application Ser. No. 14/193,210 (911-17.30-1//M-RLE-X0006), filed on 28 Feb. 2014; see another related patent application Ser. No. 14/193,269 (911-17.31-1//M-RLE-X0007), also filed on 28 Feb. 2014; and see still another patent application Ser. No. 13/917,970, (911-17.28-2//M-RLE-X0005), filed 14 Jun. 2013. All three of the aforementioned patent applications discloses a technique for solving the aforementioned air lock problem, are assigned to the assignee of the present application, and are incorporated by reference in their entirety.

The pumping chamber 130 may include a tangential discharge portion, similar to element 34 shown in FIGS. 1-4 and is configured to receive a volute portion 139. By way of example, the pumping system 100 may be configured using a possible centrifugal design that is built with the ability to have various pieces designed so that flexibility and scalability can be achieved by the selection of a specific volute configuration chosen prior to assembly. This feature greatly improves the ability to provide a pump with specific flow characteristics utilizing a larger number of common components to develop a pump family.

The pumping system 100 may include additional adapters like element 112 that allows the output configuration to be angled through multiple axes. The possibility of using multiple adapters also allows various final output connections to be made that may include any number of rigid, flexible or semi-flexible devices.

The discharge or pumping chamber 130 may include an O-ring or other flexible component 137 sealed allowing the unrestricted movement of that joint or a more restricted type movement with the selection of various sealing mechanisms.

The mounting portion or base 140 may be configured using a bracket type device that may be oriented in many positions depending upon the vertical or horizontal plane that the pumping system 100 may be attached. Usual mounting hardware of various types may be used to attach the pump including but not limited to rivets, various industrial cements, screws, bolts and other fixing devices. As shown, the mounting bracket 140 may be configured to incorporate a corresponding detent and slot arrangement or mechanism to orient the pump motor body, e.g., either without a switch (see FIG. 6) or with a switch assembly, circuit or arrangement 160 (see FIG. 7).

The switch arrangement 160 may be configured into several possible fixed positions that allow the switching mechanism, if included on the pump motor body, to be oriented as to take advantage of fixed or variable sensor placement, like element 170, allowing for multiple level sensing capabilities that can be manipulated by the user through methods that may include orientation of the motor pump assembly or possible manipulation of the sensor. This flexibility in implementation allows for a variety of level sensing options.

By way of example, the motor, pump and electronics assembly 150 may include an electrical motor, like element 58, or motor powered by another source of power. The motor pump body may come in various configurations two of which would include the switch arrangement 160 and without the switch arrangement 160 included. The switch arrangement 160 may include the fixed or variable sensor placement or additional mechanisms 170 that may affect the operation of the switch and causing certain functions of the switch to become disabled and replaced by other functions an example of that being a level sense operation of the switch and the possible ability to switch modes by the aforementioned methods to cause a different type of operation such as an automatic turn on timer function that incorporates other power sensing to determine when the pump would continue to operate and when to go back into the cycle of automatic operation repeating the cycle by use of an internal timer or some external trigger. The switch arrangement 160 may include the ability to receive an external trigger that would operate the pump regardless of its primary sense whether that is a timer in the automatic mode or a level sense type feature. Additional tabs 160*a* or exposed areas may include the description of the function that the pump is operating under which may include high or low or automatic or some other description, picture, symbol or phrase that explains in a visual or tactile manner the intended operation at that time. As certain mechanisms are moved, rotated or manipulated in other orientations, the messaging as described above may change or be exposed to explain the current intended operation.

Other Features, Including Switching and Level Sensing Options

In addition to that set forth above, the pump according to the present invention may include the following:

Another ability of this pumping system 100 is the multiple switching options available. In one embodiment, the pump can come as a manual pump utilizing a number of manual or electric or electronic switch arrangements to turn on and off.

In another embodiment, the pump can come with an included switching arrangement that is electric or electronic in nature that has the ability to turn the pump on and off detecting multiple levels of liquid. The multiple level sense ability can be chosen by the operator and is achieved by orientation of the housing that incorporates the switching mechanism. If the need for a different level sense is needed at a later time manipulation of the housing can change the level pick up sense.

The switching mechanism may also include a built-in feature that allows the pump to have an additional mode of operation which is a time dependent turn on and utilizing power detection technology, a determination of the whether the pump should stay on or turn off is achieved. This can continue the timing cycle which involves a set time elapse before a momentary turn on of the pump and the power usage technology determines whether there is sufficient drag on certain components which may include an impeller or other moving device that allows for pumping of liquids. This cycle can continue indefinitely or until the device that is causing the interference or saturation of the switch is moved so that the switch sensor no longer detects that and automatically switches into the level sense mode. In lieu of a so-called saturation switch, embodiments are also envisioned in which suitable switching functionality may be implemented using a combination of a reed switch and magnet, according to some embodiments of the present invention.

Because of the multiple level sense levels that can be achieved, the pumping system according to the present invention is more versatile fitting into various applications that were previously addressed by utilizing different pumps that fit a much more narrow application. Because of the ability to switch between the level sense and the automatic mode, the pumping system according to the present invention may achieve a far broader application schedule and capabilities.

FIG. 8

FIG. 8*a* shows the low profile pump having the motor/pump/electronics assembly 50 coupled to the mounting base 40 in a first orientation so that a water level sensor 62*a* on a PCBA 62 is located for a higher water level sensing setting. By way of example the higher water level sensing setting may be at about 2.5" above the surface to which the mounting base 40 may be coupled, although the scope of the invention is not intended to be limited to any particular height or dimension.

In comparison, FIG. 8*b* shows the low profile pump having the motor/pump/electronics assembly 50 coupled to the mounting base 40 in a second orientation so that the water level sensor 62*a* on the PCBA 62 is located for a lower water level sensing setting than that shown in FIG. 8*a*. By way of example the lower water level sensing setting may be at about 1.5" above the surface to which the mounting base 40 may be coupled, although the scope of the invention is not intended to be limited to any particular height or dimension.

In operation, the low profile pump 10 affords the user the ability to change the water level sensor setting by removing the motor/pump/electronics assembly 50 from the mounting base 40 consistent with that shown in FIG. 8*a*, rotating it 180° consistent with that shown in the transition from FIGS. 8*a* to 8*b*, and re-coupling the motor/pump/electronics assembly 50 back onto the mounting base 40 consistent with that shown in FIG. 8*b*, so that the water level sensor 62*a* on the PCBA 60 is located for a different water level sensing setting.

In FIGS. 8*a* and 8*b*, for the purpose of describing and visualizing the present invention, the water level sensor 62*a* and the PCBA 62 is being shown in relation to the switch assembly 60, although the water level sensor 62*a* and the PCBA 62 is understood to be arranged inside the switch assembly.

Moreover, it is also understood that the higher water level sensing setting will determine the high/low settings for turning on/off the low profile switch, and that the lower water level sensing setting will also determine the high/low settings for turning on/off the low profile switch, which will be different than the high/low settings determined for the higher water level sensing setting. Based on the examples of height provided above, the difference will be about 1" based on the higher water level sensing setting of about 2.5" and the lower water level sensing setting of about 1.5".

List of Some Possible Applications

The present invention has many possible applications, e.g., that may include the following:

Condensate pumping,
Air conditioner water movement,
Dehumidifier water movement,
Humidifier water movement,
Industrial water movement,
Low area water removal,
Tight quarters water removal,
Bilge pumping,
Closed compartment water removal,
Small boat casual water removal, and
Certain sump type pump operations.

THE SCOPE OF THE INVENTION

It should be understood that, unless stated otherwise herein, any of the features, characteristics, alternatives or modifications described regarding a particular embodiment herein may also be applied, used, or incorporated with any other embodiment described herein. Also, the drawings herein are not drawn to scale.

Although the present invention is described by way of example in relation to a centrifugal pump, the scope of the invention is intended to include using the same in relation to other types or kinds of pumps either now known or later developed in the future.

Although the invention has been described and illustrated with respect to exemplary embodiments thereof, the foregoing and various other additions and omissions may be made therein and thereto without departing from the spirit and scope of the present invention.

What we claim is:

1. A pumping system comprising:

a pumping chamber configured with a central portion having an outlet, and configured with a tubular coupling end portion having inwardly flexible portions, each inwardly flexible portion configured with a respective outwardly extending raised rim;

a mounting base including a circular portion having an inner circumferential wall with an inner circumferential recess configured therein to receive and engage the outwardly extending raised rims of the inwardly flexible portions of the tubular coupling end portion of the pumping chamber, so that the pumping chamber is rotationally coupled to the mounting base for 360° rotation, the circular portion having at least one slot configured or formed by recessed coupling portions; and a motor, pump and electronics assembly having an impeller and a motor for rotating the impeller, the motor, pump and electronics assembly having a housing configured with at least one outwardly extending detent, the mounting base and the motor, pump and electronics assembly being coupled together using a detent and slot arrangement configured so that the at least one outwardly extending detent slides axially into a first recessed coupling portion and rotates from the first recessed coupling portion into a second recessed coupling portion to axially lock together the motor, pump and electronics assembly and the mounting base and extend the impeller into the pumping chamber.

2. A pumping system according to claim 1, wherein the pumping system comprises a pickup nozzle or scoop having a tubular coupling and axial outlet end; and the pumping chamber is configured with a tubular coupling and axial inlet end portion to couple to the tubular coupling and axial outlet end of the pickup nozzle or scoop.

3. A pumping system according to claim 1, wherein the mounting base comprises one or more lower mounting legs with apertures formed therein and configured to be mounted to a surface or workpiece, including via a fastener.

4. A pumping system according to claim 1, wherein the circumferential wall is configured with at least one slotted opening formed therein for receiving the at least one outwardly extending detent of the housing for coupling together the mounting base and the motor, pump and electronics assembly.

5. A pumping system according to claim 1, wherein the pumping system is, or forms part of, a bilge pump.

6. A pumping system according to claim 1, wherein the circular portion comprises an inner circumferential wall, and the recessed portions of the at least one slot are formed or configured as detents in the inner circumferential wall.

7. A pumping system according to claim 1, wherein the circular portion comprises a circumferential wall, and the recessed portions of the at least one slot are formed or configured as slits or apertures in the circumferential wall.

8. A pumping system according to claim 1, wherein the detent and slot arrangement is configured so that the at least one outwardly extending detent slides axially into a third recessed portion to prevent a rotation from the second recessed portion back into the first recessed portion.

9. A pumping system according to claim 1, wherein the detent and slot arrangement is configured with a pair of outwardly extending detents and a corresponding pair of slots, each slot having corresponding recessed portions.

10. A pumping system according to claim 9, wherein the pair of outwardly extending detents are diametrically opposed on the housing and the corresponding pair of slots are diametrically opposed on the circular portion.

11. A pumping system according to claim 1, wherein the detent and slot arrangement is configured with four outwardly extending detents and four corresponding slots.

12. A pumping system according to claim 11, wherein the four outwardly extending detents are arranged equi-distant about the housing; and the four corresponding slots are arranged equi-distant about the circular portion.

13. A pumping system comprising:

a pumping chamber configured with a central portion having an outlet, and configured with a tubular coupling end portion having inwardly flexible portions, each inwardly flexible portion configured with a respective outwardly extending raised rim; and a mounting base including a circular portion having an inner circumferential wall with an inner circumferential recess configured therein to receive and engage the outwardly extending raised rims of the inwardly flexible portions of the tubular coupling end portion of the pumping chamber, so that the pumping chamber is rotationally coupled to the mounting base for 360° rotation;

the pumping system having a motor, pump and electronics assembly with an impeller and a motor for rotating the impeller; and the mounting base and the motor, pump and electronics assembly being coupled together using a detent and slot arrangement so that the impeller extends into the pumping chamber, the motor, pump and electronics assembly having a housing configured with at least one outwardly extending detent formed or configured thereon, and the mounting base having a circumferential wall configured with at least one inwardly extending slot for receiving the at least one outwardly extending detent of the housing for coupling together the mounting base and motor, pump and electronics assembly;

the pumping system having a switching assembly having a printed circuit board assembly with a water level sensor configured to respond to a water level and turn the motor in the motor, pump and electronics assembly on and off, the switching assembly arranged in a housing part of the motor, pump and electronics assembly;

the at least one outwardly extending detent having two diametrically opposed outwardly extending detents formed or configured on the housing, and the at least one inwardly extending slot having two diametrically opposed inwardly extending slots for receiving the two diametrically opposed outwardly extending detents of the housing for coupling together the mounting base and the motor, pump and electronics assembly in at least two rotational orientations that differ by 180°, including a first rotational orientation so that the water level sensor is located at a higher height in the housing part for providing a higher water level sensing setting, and a second rotational orientation so that the water level sensor is located at a lower height in the housing part for providing a lower water level sensing setting.

* * * * *